US007055601B2

(12) United States Patent
Barrow

(10) Patent No.: US 7,055,601 B2
(45) Date of Patent: Jun. 6, 2006

(54) METHOD AND SYSTEM FOR ESTIMATING THE POSITION OF A MOVABLE DEVICE IN A BOREHOLE

(75) Inventor: Harry Barrow, Girton (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 166 days.

(21) Appl. No.: 10/732,989

(22) Filed: Dec. 11, 2003

(65) Prior Publication Data

US 2004/0168797 A1 Sep. 2, 2004

(30) Foreign Application Priority Data

Dec. 11, 2002 (GB) ..... 0228884.3

(51) Int. Cl.
*E21B 47/09* (2006.01)

(52) U.S. Cl. ..... 166/255.1; 166/64

(58) Field of Classification Search ..... 175/40, 175/50; 166/255.1, 64, 250.1; 340/854.1; 702/6

See application file for complete search history.

(56) References Cited

U.S. PATENT DOCUMENTS

| | | | | |
|---|---|---|---|---|
| 3,193,004 A | * | 7/1965 | Albright et al. | 166/252.4 |
| 3,798,962 A | * | 3/1974 | Dibley et al. | 73/9 |
| 4,812,977 A | | 3/1989 | Hulsing | |
| 4,843,875 A | | 7/1989 | Kerbart | |
| 4,945,775 A | | 8/1990 | Adams et al. | |
| 5,416,750 A | | 5/1995 | Doyen et al. | |
| 5,483,061 A | | 1/1996 | Sloan | |

(Continued)

FOREIGN PATENT DOCUMENTS

| | | |
|---|---|---|
| EP | 0 864 882 A2 | 6/1998 |
| EP | 0 864 882 A3 | 12/1998 |

OTHER PUBLICATIONS

Borenstein et al 'Where am I?' Sensors and methods for mobile robot positioning The University of Michigan, 1996.
Rubin Using the SIR algorithm to simulate posterior distributions Bayesian Statistics 3, Oxford University Press, 1988, pp. 395-402.
Tanner (edited Berger et al) Lecture notes in statistics, Tools for statistical inference observed data and data augmentation methods Springer-Verlag, 1991, chapter II, pp. 6-15.
Thrun Probabilistic robotics Communications of the ACM, Mar. 2002, vol. 45, No. 3.
Thrun et al Robust Monte Carlo localization for mobile Roberts Artificial Intelligence 128 (2001), Elsevier Science B.V. pp. 99-141.

*Primary Examiner*—Kenneth Thompson
(74) *Attorney, Agent, or Firm*—Jody Lynn DeStefanis; William L. Wang; Steven Gahlings

(57) ABSTRACT

A method is provided for estimating the position of a movable device in a borehole. The method comprises the steps of:

(a) providing a prior location probability distribution associated with a first position of the device in the borehole, (b) providing a measurement of a putative distance moved by the device and/or a measurement of a characteristic of the surroundings of the device, the or each measurement being associated with movement of the device to a subsequent position in the borehole, and (c) calculating a posterior location probability distribution associated with the subsequent position, the posterior location probability distribution being conditional on the prior location probability distribution, and the or each measurement.

11 Claims, 2 Drawing Sheets

U.S. PATENT DOCUMENTS 5,522,260 A 6/1996 Chappellat et al.
5,539,704 A 7/1996 Doyen et al.
5,996,726 A * 12/1999 Sorrells et al. ..... 181/106
6,182,013 B1 * 1/2001 Malinverno et al. ..... 702/7
6,405,798 B1 6/2002 Barrett et al.
6,886,632 B1 * 5/2005 Raghuraman et al. ... 166/252.4

* cited by examiner

METHOD AND SYSTEM FOR ESTIMATING THE POSITION OF A MOVABLE DEVICE IN A BOREHOLE

FIELD OF THE INVENTION

This invention relates to a method and system for estimating the position of a movable device in a borehole.

BACKGROUND OF THE INVENTION

There are a number of situations in which it is desirable to be able to estimate accurately position in a hydrocarbon well borehole. For example:

- when making a wireline log or analysing a slickline log, the position of the logging tool is needed when each measurement is made;
- when intervening in a well with coiled tubing, the position of the tool at the end of the tubing is required;
- when drilling, the location of the bottom hole assembly (BHA) and bit is needed; and
- when inserting an autonomous device (e.g. of the type disclosed in U.S. Pat. No. 6,405,798) into a well, the device should be able to determine its own position for navigation.

For each of these situations, application-specific dead-reckoning approaches to estimate position may be adopted. For example, one approach is to measure the length of wireline, drill pipe or coiled tubing reeled out. Alternatively, on a wheeled downhole device an odometer can be used to measure distance travelled.

A dead-reckoning technique widely used in other technical fields is inertial navigation. In general, to estimate an arbitrary change in position, three accelerometers are needed to measure acceleration in three directions, the measurements being integrated twice. U.S. Pat. Nos. 4,945,775 and 4,812,977 disclose inertial navigation systems for use in wellbores which have three accelerometers. However, at least for the purpose of depth correction in an essentially one-dimensional system, such as a wellbore, three accelerometers are sometimes not necessary. For example, U.S. Pat. No. 5,522,260 discloses a procedure for performing depth correction on a logging tool having two spaced logging sensors in which the tool is provided with one accelerometer. In the procedure, the tool velocity determined by correlating the sensor logs is combined with the tool velocity determined by the accelerometer to produce a depth correction for the tool.

Physical models may also be employed to improve the accuracy of the dead-reckoning calculation. For example, U.S. Pat. No. 4,843,875 describes a procedure for measuring drill bit rate of penetration which assumes that the behaviour of the drill string can be modelled by an equation which relates instantaneous drill bit velocity to the instantaneous velocity of the drill string at the surface, the apparent compliance of the drill string, and the first derivative with respect to time of the weight suspended from the hook.

However, all of these approaches are subject to various types of error: wheels with odometers may slip, coiled tubing has a tendency to coil in the borehole, double integration magnifies errors, models of elasticity and friction may not be accurate. Because of this, when using dead-reckoning the magnitude of the error tends to increase with distance travelled.

Consequently, other approaches to position determination within boreholes are sometimes used. One approach is based on landmark recognition. Downhole devices may be fitted, for example, with casing collar locators (CCL) which can sense when the tool is adjacent a casing joint. However, a CCL may occasionally fail to detect an adjacent casing collar, or may spuriously detect a non-existent collar, due to noise. Because the sensors are usually not able to distinguish between different casing collars, this results in uncertainty in position. Moreover, if a logging tool fitted with a CCL encounters a fork in a bore, it may not be clear merely from the CCL reading, which branch of the bore has been followed by a logging tool. Furthermore, for absolute (as opposed to relative) position determination, the positions of the casing joints must be known beforehand.

Another approach is to provide the downhole device with a sensor which is able to measure some characteristic of the wellbore environment, for example a gamma-ray sensor to measure the amount of gamma-rays emanating from the surrounding rock formation. If the gamma-ray profile of the well is known, the sensor readings can be correlated with the profile and position determined in this way. This form of position determination is called map-matching. However, map-matching can affected by sensor noise, as well as suffering from drawbacks similar to those associated with landmark recognition.

Although unrelated to the technical field of the present invention, a navigation technique has been developed by Thrun and co-workers (see Thrun, Fox, Burgard and Dellaert, *Robust Monte Carlo Localization for Mobile Robots*, Artificial Intelligence Journal, 2000). The technique was developed for use by a wheeled mobile robot operating in an environment of rooms and corridors. It uses information from wheel odometers, laser and sonar range-finders, and a TV camera that looks at the ceiling.

The Monte Carlo Localization (MCL) approach adopted by Thrun and co-workers is a Bayesian method that estimates a probability distribution function (PDF) for the location (and orientation) of the robot. Whenever the robot moves, the PDF can be updated using a predictive stochastic model of the robot motion and observational data from the sensors.

SUMMARY OF THE INVENTION

An object of the present invention is to evaluate and preferably to improve the accuracy of downhole position measurements.

In a first aspect, the invention provides a method for estimating the position of a movable device in a (preferably hydrocarbon well) borehole, the method comprising the steps of:

(a) providing a prior location probability distribution associated with a first position of the device in the borehole, (b) providing a measurement of a putative distance moved by the device and/or a measurement of a characteristic of the surroundings of the device, the or each measurement being associated with movement of the device to a subsequent position in the borehole, and (c) calculating a posterior location probability distribution associated with the subsequent position, the posterior location probability distribution being conditional on the prior location probability distribution, and the or each measurement.

Typically, steps (a) to (c) are repeated for further positions of the device, the posterior location probability distribution of one repeat becoming the prior location probability distribution of the following repeat. In this way the method can be used to track the position of the device (which may be a logging tool, a BHA etc.) as it moves along the borehole. This tracking can be in real time or can be a reconstruction based on previously acquired data.

Thus the invention implements a Bayesian approach to downhole position estimation, whereby the location probability distribution at one position is used in the calculation of the location probability distribution of the following position.

Although, like conventional dead-reckoning approaches to downhole position estimation, the method can result in increasing errors as the distance travelled by the device increases, a significant advantage over these approaches is that the extent of the error can be quantified by the probability distribution. This may be particularly useful if the method is being used to track a device which is to perform a critical operation (such as casing perforation) at a predetermined position in the wellbore. For example, even if the device is tracked to the region of the predetermined position, an operator may choose to abort such an operation if the method indicates that the probability distribution is insufficiently focussed on that position.

Some known inertial navigation systems depend upon Kalman filter technology to perform the integration of accelerations and velocities and thus determine position. A Kalman filter requires a model of how the state of the system, as represented by accelerations, velocities, and positions, rotational velocities and orientations, changes over time, and a model of how any measurements depend upon these variables. The filter in inertial navigation systems calculates a best estimate of the values of the state variables at a given time from their previous values and from certain measurements from accelerometers and gyroscopes or similar orientation sensors. The filter also calculates a covariance matrix for the variables as a simple representation of the distribution of possible values. In order to calculate the covariances, it relies upon the assumption that all errors, in system variables and in measurements, have a zero-mean Gaussian distribution.

The assumption that all variables and measurements have zero-mean Gaussian distributions is not always adequate for a device in a borehole. For example, in the case where the device has odometers on drive wheels, the error distribution resulting from wheel slip is one-sided, and hence not zero-mean Gaussian. In the case of environment sensors, such as gamma ray sensors, or casing collar locators, the measurements do not correspond to simple functions of the state variables, and so cannot be used as direct input to a Kalman filter. For example, a particular value of a gamma ray measurement may be obtainable at many different locations in a borehole. This results in probability distributions that have multiple peaks and valleys, and are hence not Gaussian.

Therefore, a Kalman filter by itself is not adequate for combining motion sensor data with environmental data. The method and system proposed here allow these two types of data to be combined. The present invention can be implemented as a system in which a Kalman filter is used to perform the basic double integration of accelerometer measurements, which can be assumed to have zero-mean Gaussian noise, with the representation of probability distributions resulting from the environment measurements using a grid representation or particle filter representation, and the combination of motion sensor information from the Kalman filter and the environment information is performed using the techniques described below.

The present invention provides a convenient platform for combining, in the calculation of the location probability distribution, measurements which may derive from disparate sources but which can carry useful information concerning the repositioning of the device. This combination is advantageous because the range of likely positions for the device, as defined by the location probability distribution, is itself likely to be narrower when the amount of information used to calculate the probability distribution is increased.

In one embodiment, at step (b) a measurement of the putative distance moved by the device is provided. For example, the device may comprise an odometer to measure the putative distance moved by the device.

The measured characteristic of the surroundings of the device may be e.g. an indication of whether the device is adjacent to a borehole casing collar, or a measure of the amount of gamma-rays emanating from the surrounding rock formation. Thus in one embodiment the device comprises a CCL, and in another embodiment the device comprises a gamma-ray sensor.

Preferably, at step (b) a plurality of measurements (more preferably at least three, four or five measurements) of the characteristics of the surroundings of the device are provided.

A particular advantage of the approach is that it permits the combination of evidence from multiple sensors (including odometers) to yield more accurate depth estimates than are possible with a single sensor or technique. Error from odometers grows with distance, but detection of landmarks reduces error spread again. For example, it was found that by applying the present invention to measurements from odometers, CCLs and gamma ray sensors together, the error can be kept to within 20 centimeters over a distance of several kilometers. In contrast, dead-reckoning errors could be tens or hundreds of metres over this distance.

Furthermore, the method has the capacity to combine dead-reckoning, landmark recognition and map-matching approaches to position estimation. This ability to use information from a variety of sources and sensors increases the range of possible applications in which the method can usefully be employed. It also increases the robustness of the method. For example, if one of the sources or sensors fails, or becomes otherwise unavailable, the location probability distribution can still be calculated for subsequent positions with the information from the remaining sources and sensors.

Further aspects of the invention provide (a) a computer system operatively configured to perform the method of the first aspect, (b) computer readable media carrying computer code for performing the method of the first aspect, and (c) a computer program for performing the method of the first aspect.

In one embodiment the computer system is remote from the movable device, e.g. above ground. However, in another embodiment it is incorporated into the movable device, for example so that the movable device can behave autonomously.

By a "computer system" we mean the hardware, software and data storage used to estimate position in a borehole. For example, a computer-based system of the present invention may comprise a central processing unit (CPU), input means, output means and data storage. Desirably a monitor is provided to visualise wellbore position and location probability distributions. The data storage may comprise RAM or other computer readable media.

By "computer readable media" we mean any medium or media which can be read and accessed directly by a computer e.g. so that the media is suitable for use in the above-mentioned computer system or for carrying computer code for performing the method of the first aspect. The media include, but are not limited to: magnetic storage media such as floppy discs, hard disc storage medium and magnetic tape; optical storage media such as optical discs or CD-ROM; electrical storage media such as RAM and ROM; and hybrids of these categories such as magnetic/optical storage media.

One aspect of the invention provides a computer system for estimating the position of a movable device in a borehole, the system comprising:

data storage for storing the prior location probability distribution associated with a first position of the device in the borehole, a measurement provision system for providing a measurement of a putative distance moved by the device and/or a measurement of a characteristic of the surroundings of the device, the or each measurement being associated with movement of the device to a subsequent position in the borehole, and a processor for calculating a posterior location probability distribution associated with the subsequent position, the posterior location probability distribution being conditional on the prior location probability distribution, and the or each measurement.

If the position estimation is being performed in real time, the measurement provision system may comprise apparatus (such as electrical/optical transmitters and receivers, electrical/optical cabling etc.) for acquiring measurement signals from the measuring sensor(s) (odometer, CCL, gamma-ray sensor etc.) to the computer system. Alternatively, for off-line position estimation, the measurement provision system may comprise computer readable media carrying previously acquired measurement data.

Typically, the processor calculates the posterior location probability distribution for further positions of the device, the data storage and the processor being configured such that after each calculation the posterior location probability distribution is stored in the data storage and becomes the prior location probability distribution for the next calculation.

DETAILED DESCRIPTION OF THE INVENTION

Theoretical Considerations

Figure 1:
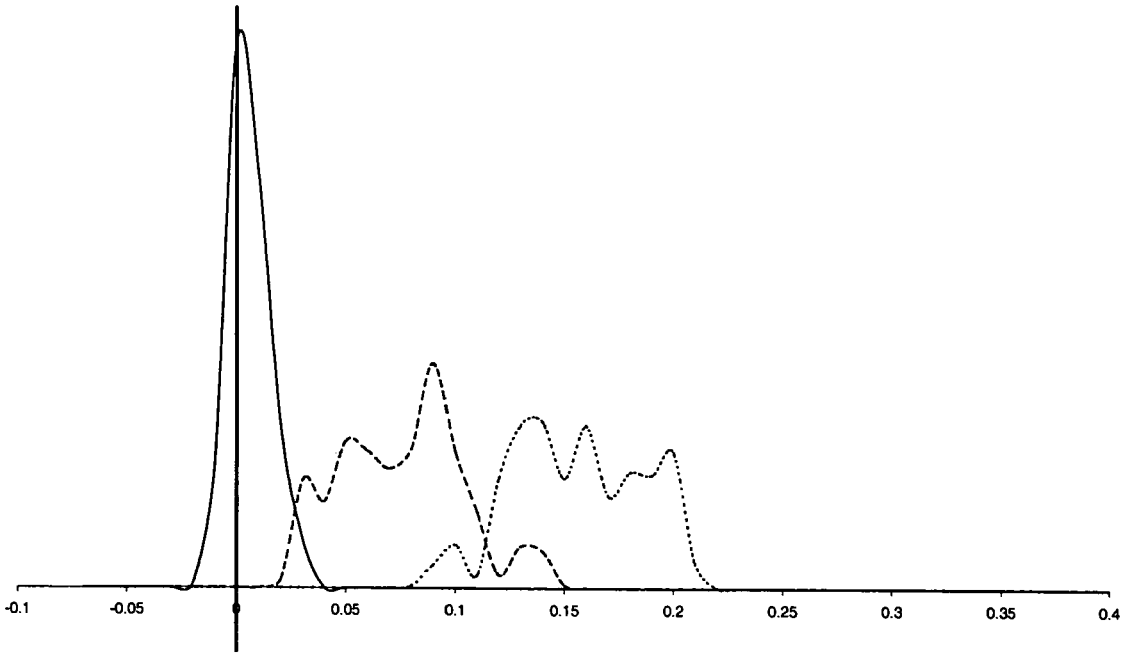
FIGS. 1 and 2 show example PDFs from a computer simulation of the method.

For the purpose of explanation, we assume a downhole device which is faced with a one-dimensional localization problem. The location of the device in the well is described by a single depth value, d. We begin with an initial or prior PDF for depth, $P_0(d)$. When the device performs some action a, such as moving forward, the effect of the action is described by a conditional PDF $P(d|a,d_0)$, where do is the initial location and dis the final one. The new PDF is then given by:

$$P(d)=\int P(d|a,d').P_0(d').dd'$$

If the device now makes sensory observations of its surroundings, which we represent by o, by Bayes' theorem we can update the PDF, to give a posterior PDF, P'(d) as follows:

$$P'(d)\propto P(o|d).P(d)$$

The constant of proportionality is readily determined since $\int P'(d).dd=1$.

One way to represent the depth PDF would be as a 1-D grid or histogram, with each cell representing a (small) range of distances and the value stored in the cell being the probability that the true distance lies within the cell. In practice, this is not a very efficient representation: to obtain precision of location, very many small cells are required, most of which contain almost zero probability most of the time.

A better technique is generally to represent the PDF by a set of samples, or particles. Each particle represents a particular hypothesis, with a weight. For the depth location problem, a particle is represented as a 2-tuple:<d;w>. A PDF can be approximated arbitrarily well by a set of particles, the more particles the more precise the approximation. Properties of the PDF, such as mean and variance, for example, are readily estimated from the particle set, in the usual way.

The updating rules defined above may be approximated by a stochastic sampling technique applied to the set of representative particles, as follows:

1. Choose a particle randomly from the set, with probabilities proportional to their weights. Suppose the depth of the particle is $d_0$.
2. Choose a new depth, d, resulting from the given action,a, randomly from the distribution $P(d|a,d_0)$. This will be the depth for a new particle.
3. Determine the weight for the new particle as P(o|d), where o represents the sensor measurements.
4. Repeat from step 1 until a desired number of particles have been created.
5. Re-normalize the weights of the new particles so that they sum to 1.
6. Replace the old set of particles by the new one.

The representation and algorithm just described is a particular form of Bayesian filter, known as a particle filter. It can be shown that, regardless of the initial estimate of the PDF, as the algorithm (i.e. steps 1 to 6) is iterated it converges to approximate the true PDF. It also has the helpful and efficient property of creating most particles in regions of highest probability. For more on particle filters, see Rubin, *Using the SIR Algorithm to Simulate Posterior Distributions*, in *Bayesian Statistics* 3, OUP, 1988; and Tanner, *Tools for Statistical Inference*, Springer, 1993.

Particles can be used to represent discrete sets of outcomes as well as continuous ones like depth. Suppose the device reaches a fork in its path and takes one branch, but does not know which. The particle representation can be simply modified to include a two-valued variable, b, that represents the branch taken. A particle is now represented as <d,b;w>. The conditional probability model for movement at the fork must include the probabilities for taking the left or right branch, in a straightforward way. The PDF is now comprised of two subsets of particles corresponding to the two branches. The probability of being in the left branch, for example, can be estimated by summing the weights of the left branch particles. As time proceeds and the algorithm is iterated, the branch probabilities move from their a priori values towards 1 or 0.

In a similar way, if the conditional probabilities $P(d|a,d_0)$ and/or P(o|d) depend upon some parameter that is initially unknown, the parameter may be estimated simultaneously with depth. For example, pressure observations depend upon both depth and fluid density, but the latter may be unknown.

To estimate an unknown parameter, $\pi$, we consider the 2-D joint probability distribution of $(d,\pi)$. We can represent this PDF by a set of particles, as before, denoted by $<d,\pi;w>$. The marginal PDF for d is estimated simply by summing the joint distribution over $\pi$, and that for $\pi$ by summing over d.

Finally, because depth information is maintained as a PDF, rather than as a single value, we may readily determine the most likely value for depth, together with an estimate of its accuracy derived from standard deviation or other statistic. We may even determine whether a discrete ambiguity exists, by determining whether the distribution is uni-modal or multi-modal.

EXAMPLE

We have applied the above theory to the example of a downhole autonomous robot. Dead reckoning information is obtainable from an odometer fitted to the robot's wheels. This is liable to errors due to slippage, and the conditional PDF, $P(d|a,d_0)$, may be used to model the effect of attempting to move the distance registered by the odometer. Alternatively, inertial navigation may be used, with its own error sources and stochastic model of $P(d|a,d_0)$.

Some landmark information is obtainable from a CCL that detects casing joints in a cased hole. Other landmark detection schemes may also be employed, such as detecting the presence of casing perforations. For each landmark, we can devise a mathematical model that gives the probability of detecting the landmark from an arbitrary position, $P(o|d)$.

Map-matching information can come from the increase in pressure and temperature with depth, and from any other suitable logging sensor (such as a gamma-ray sensor). Less precise map information may come from a seismic survey, or from logs from offset wells. From a map of the known values of sensor measurements along the borehole, one may readily devise a mathematical model that gives $P(o|d)$.

Finally, assuming that the observations are independent of each other at a given depth. Hence $$P(o \mid d) = \prod_i P(o_i \mid d)$$

where the $o_i$ are the different observations, and o is their conjunction.

When the robot is at the top of the well, it begins with an initial PDF that is narrow and likewise located at the top of the well. As the robot proceeds, the odometer slippage widens the distribution as it moves down the well. However, when a casing joint, or other landmark, is detected the PDF narrows again around the known landmark location. Note that in the absence of the odometer information the robot would not know which casing joint had been detected, and the PDF would become multi-modal, with peaks at each of the joints.

If the robot loses traction and slides or falls a distance down the well, the method can recover. For example, temperature or pressure information would help to determine roughly where the robot is, with a broad distribution for the PDF. If the fall can be detected, for example, using inertial navigation, it can be incorporated by modelling it as a robot action, which serves to contain the spread of the PDF. If the robot has a sensor that permits map-matching, the PDF may recover and converge again gradually to accurate values.

Figure 2:
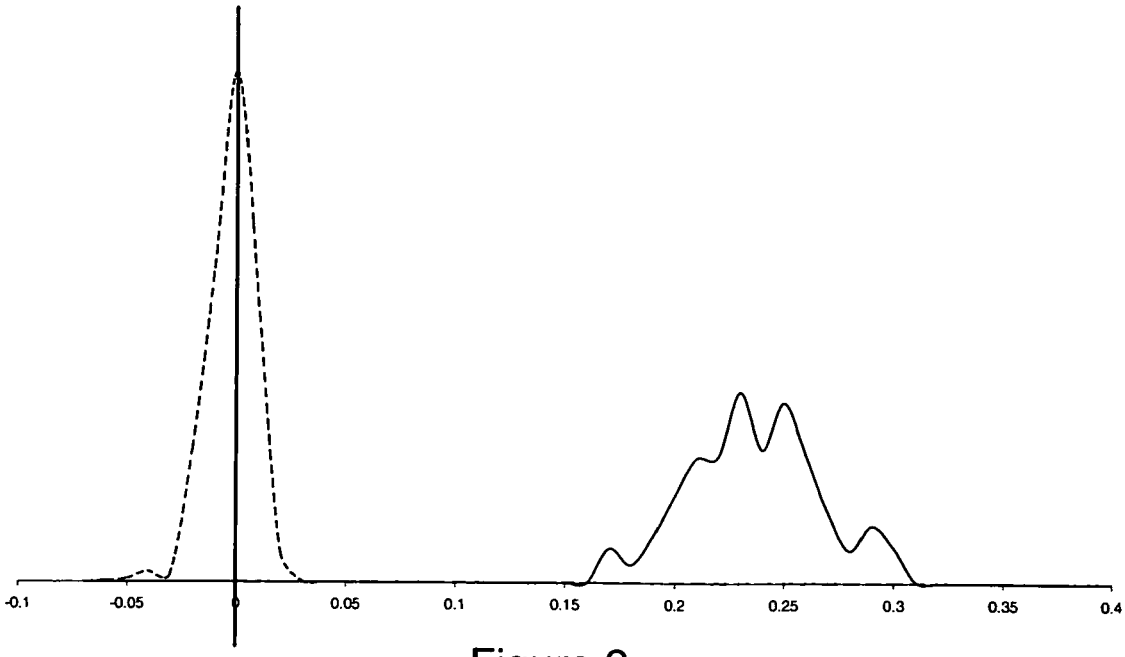

FIGS. 1 and 2 show example PDFs from a computer simulation of the method. On each figure the abscissa plots distance along the borehole relative to the instantaneous actual location (represented by the position of the vertical line) of the autonomous robot.

FIG. 1 shows an initial PDF (solid curve) and the PDF calculated at two later times (dashed curve and dotted curve). As time proceeds, the PDF becomes wider, reflecting increasing error due to odometry noise, and shifts to the right, reflecting a systematic odometry scaling error.

FIG. 2 shows what happens when a landmark, in this case a casing collar, is encountered. Prior to the detection of the landmark, the PDF is as shown by the solid curve. After detection, the PDF is updated to that shown by the dashed curve. The Bayesian calculation results in both a shift left to the actual depth (a removal of systematic error), and a narrowing of the distribution (a removal of accumulated noise error).

The system can also deal with situations that involve discrete alternatives. For example, the CCL may be unable to distinguish which casing joint is observed, but the PDF easily reflects the ambiguity. When the robot reaches a bifurcation, as in a multilateral well, it may not be obvious initially which branch has been taken. In this situation, one approach would be to recast the problem in two or three dimensions. However, generally it is preferred to maintain a PDF that explicitly incorporates the two hypotheses. This may be done in the Bayesian particle filter representation, as described above. As information is accumulated from sensors and landmarks, the probabilities associated with one branch will increase, while those of the other branch decline to zero. Eventually, so long as the branches are distinguishable, it becomes clear which branch was taken, and the other hypothesis may be dropped.

The system can also deal with sensor failures. For example, sensory data can be monitored for indications of a problem, such as constant zero or full-scale output, or excessive variation in the measurements. If this is detected, the problem observations from that sensor can simply be omitted in the PDF updating procedure.

It is sometimes the case that a useful well parameter is unknown. For example, if the fluid density is known, pressure can be used to estimate (vertical) depth. More frequently, however, fluid density is not known precisely. With the system proposed here, a parameter such as fluid density may be treated as an unknown parameter, $\pi$, and, as described above, factored into a multi-dimensional PDF, $(d,\pi)$. The fluid density can then be estimated simultaneously with depth.

Figure 3:
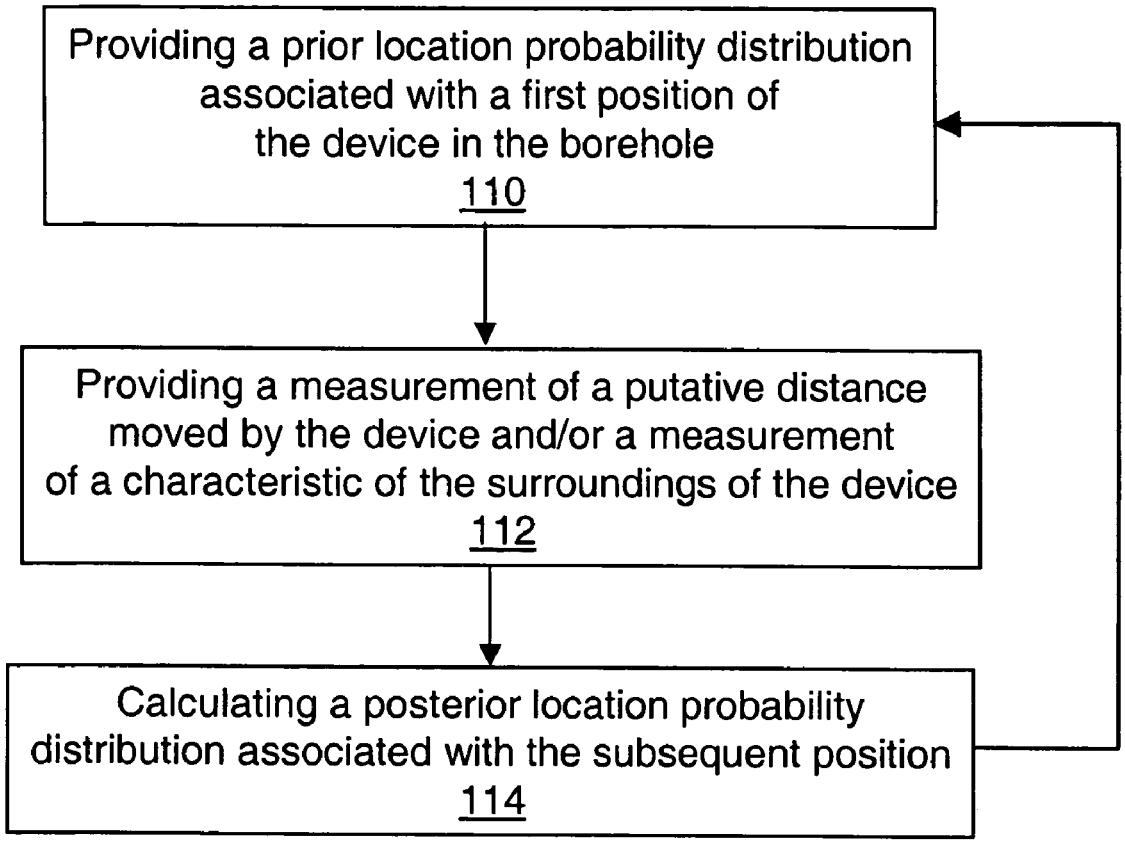
FIG. 3 is a flowchart showing steps in estimating the position of a movable device in a borehole according to preferred embodiments of the invention.

FIG. 3 is a flowchart showing steps in carrying out embodiments of the invention. In step 110 a prior location probability distribution associated with a first position of the device in the borehole is provided. In step 112, a measurement of a putative distance moved by the device and/or a measurement of a characteristic of the surroundings of the device is provided. Each measurement is associated with movement of the device to a subsequent position in the borehole. In step 114 a posterior location probability distribution associated with the subsequent position is calculated. The posterior location probability distribution being conditional on the prior location probability distribution of each measurement.

Typically, steps 110 to 114 are repeated for further positions of the device, the posterior location probability distribution of one repeat becoming the prior location probability distribution of the following repeat. In this way the method can be used to track the position of the device (which may be a logging tool, a BHA etc.) as it moves along the borehole. This tracking can be in real time or can be a reconstruction based on previously acquired data.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A method for estimating the position of a movable device in a borehole, the method comprising the steps of:

(a) providing a prior location probability distribution associated with a first position of the device in the borehole, (b) providing a measurement of a putative distance moved by the device and/or a measurement of a characteristic of the surroundings of the device, the or each measurement being associated with movement of the device to a subsequent position in the borehole, and (c) calculating a posterior location probability distribution associated with the subsequent position, the posterior location probability distribution being conditional on the prior location probability distribution, and the or each measurement, wherein the device is a borehole tool carrying sensors to provide measurements relating to properties of the borehole or of the surrounding formations.

2. A method according to claim 1, wherein steps (a) to (c) are repeated for further positions of the device, the posterior location probability distribution of one repeat becoming the prior location probability distribution of the following repeat.

3. A method according to claim 1, wherein the borehole is a hydrocarbon well borehole.

4. A method according to claim 1, wherein the device is a borehole logging tool.

5. A method according to claim 1, wherein the device is a drill string bottom hole assembly.

6. A method according to claim 1, wherein at step (b) a measurement of the putative distance moved by the device is provided.

7. A method according to claim 6, wherein the device comprises an odometer which measures the putative distance.

8. A method according to claim 1, wherein at step (b) a measurement indicating whether the device is adjacent to a borehole casing collar is provided.

9. A method according to claim 1, wherein at step (b) a measurement of the amount of gamma-rays emanating from the surrounding rock formation is provided.

10. A method according to claim 1, wherein the representation of probability distribution resulting from at least one measurement is not zero-mean Gaussian.

11. A method according to claim 10, wherein a Kalman filter is used to process measurements with zero-mean Gaussian distribution and a grid distribution or particle filter is used to process measurements with non zero-mean Gaussian distribution.

* * * * *